US007445133B2

(12) United States Patent
Ludovissie et al.

(10) Patent No.: US 7,445,133 B2
(45) Date of Patent: Nov. 4, 2008

(54) MULTIPLE BEVERAGE AND FLAVOR ADDITIVE BEVERAGE DISPENSER

(76) Inventors: Daniel Ludovissie, 11105 Aspen Cir., Champlin, MN (US) 55316; E. Scott Sevcik, 1802 Moorland La., Crystal Lake, IL (US) 60014; Daniel C. Leaver, 22 E. 60th St., Westmont, IL (US) 60559; Kevin Brandt, 323 Sharon Dr., Barrington, IL (US) 60010

( * ) Notice: Subject to any disclaimer, the term of this patent is extended or adjusted under 35 U.S.C. 154(b) by 414 days.

(21) Appl. No.: 10/962,768

(22) Filed: Oct. 12, 2004

(65) Prior Publication Data

US 2005/0115989 A1 Jun. 2, 2005

Related U.S. Application Data

(60) Provisional application No. 60/510,757, filed on Oct. 12, 2003.

(51) Int. Cl.
*B67D 5/60* (2006.01)

(52) U.S. Cl. ..... 222/145.5; 222/129.1

(58) Field of Classification Search ... 222/145.5–145.8, 222/129.1–129.4; 239/423, 428, 429, 106, 239/433

See application file for complete search history.

(56) References Cited

U.S. PATENT DOCUMENTS

| | | | | | |
|---|---|---|---|---|---|
| 2,770,502 | A | * | 11/1956 | Hodge | 239/417.3 |
| 3,966,091 | A | * | 6/1976 | Bencic | 222/129.1 |
| 4,218,014 | A | * | 8/1980 | Tracy | 239/106 |
| 4,509,690 | A | * | 4/1985 | Austin et al. | 239/429 |
| 4,619,378 | A | * | 10/1986 | de Man | 222/144.5 |
| 4,753,370 | A | * | 6/1988 | Rudick | 222/105 |
| 4,932,564 | A | * | 6/1990 | Austin et al. | 222/129.1 |
| 5,002,204 | A | * | 3/1991 | Sakai | 222/129.1 |
| 6,182,555 | B1 | * | 2/2001 | Scheer et al. | 99/290 |
| 6,253,963 | B1 | * | 7/2001 | Tachibana | 222/129.1 |

* cited by examiner

*Primary Examiner*—Lien T Ngo
(74) *Attorney, Agent, or Firm*—Pyle & Piontek, LLC

(57) ABSTRACT

A beverage dispensing head for a beverage dispenser admixes diluent and syrup for dispensing into a cup. The dispensing head has a nozzle with a diluent receiving surface that leads downward to a juncture of the surface with an outlet from the nozzle. Diluent delivered to the dispensing head is introduced onto the diluent receiving surface for flow along the surface to and past the juncture. Syrup delivered to the dispensing head is emitted in the nozzle as a plurality of discrete streams directed toward and against diluent at the juncture for admixture with the diluent. The admixture of diluent and syrup then exits the dispensing head nozzle through the nozzle outlet for being dispensed into the cup.

5 Claims, 10 Drawing Sheets

MULTIPLE BEVERAGE AND FLAVOR ADDITIVE BEVERAGE DISPENSER

This application claims benefit of provisional application Ser. No. 60/510,757, filed Oct. 12, 2003.

FIELD OF THE INVENTION

The present invention relates generally to post-mix beverage dispensing valves.

BACKGROUND OF THE INVENTION

Post-mix beverage dispensing valves typically provide for the mixing of beverage syrup with a diluent such as carbonated or plain (non-carbonated) water. Most such valves dispense only one brand or flavor at a time, although beverage dispensing valves that are capable of dispensing a plurality of beverages out of a single dispensing nozzle are known in the art. These multiple flavor dispensing valves increase the number of brands of drinks that can be dispensed from a dispenser of a given size or footprint. However, conventional multiple flavor post-mix beverage dispensing valves generally do not perform as well as individual dedicated valves, particularly with respect to dispensing a drink that has a high level of carbonation. Improvements in controlling dispensed drink carbonation levels in post-mix multiple flavor valves are always desirable.

Certain drinks can be modified by the addition of a staple flavoring such as cherry, vanilla, lemon or lime. These flavorings can be added to the basic syrup formulation as provided to a user, but that undesirably adds significantly to the number of beverage dispensing valves required due to the need to dispense an increased number of differently flavored drinks, especially where the valves are of the dedicated single flavor variety. Naturally, multiple flavor valves can be used, but such conventional valves do not necessarily fully alleviate the problem, particularly when further variations of the basic drink flavor are required, such as caffeinated or non-caffeinated.

Accordingly, it is known to have separate valves that provide for the dispensing of only a pure flavoring that can be added, in a separate operation, to the main drink after it has been dispensed into a cup or into the empty cup just before dispensing the main drink. In this way, the flavoring can be selectively added, or not, to any of the drinks dispensed by the particular beverage dispensing machine, thereby providing more drink varieties from a single machine. However, a problem with existing flavor additive machines is their complexity, particularly from a user interface point of view. It is important that use of such machines be clear and intuitive, especially since most such machines are used by the public on a self-service basis, as opposed to being used exclusively by trained restaurant personnel. It is also desirable to have a post-mix beverage dispenser that can provide for the greatest number of drink and additive flavor combinations in a given size or footprint machine.

SUMMARY OF THE INVENTION

In accordance with the present invention, a beverage dispensing head for a beverage dispenser comprises a nozzle having a diluent receiving surface that leads to a juncture of the surface with an outlet from the nozzle. Also included are means for introducing liquid diluent onto the diluent receiving surface for flow along the surface to and past the juncture and through the outlet, and means for directing a plurality of discrete streams of liquid beverage syrup toward the juncture for impact against and admixture with diluent substantially at the juncture, so that admixed diluent and syrup exit the dispensing head nozzle through the outlet.

In a preferred embodiment, the beverage dispensing head includes a dispensing body having at least one diluent inlet for connection with a source of diluent and a plurality of syrup inlets for connection with associated sources of syrup. A plurality of syrup passage means each extend between an associated syrup inlet and the nozzle for delivering syrup from the syrup inlets to the nozzle, and each the syrup passage means has an outlet at the nozzle for emitting a plurality of discrete streams of syrup directed toward the juncture. A diluent distribution ring is intermediate the dispensing body and the nozzle for receiving diluent from the dispensing body diluent inlet and introducing the diluent onto the nozzle diluent receiving surface. The syrup passage means extends through the diluent distribution ring and the diluent distribution ring has an annular chamber in communication with the at least one diluent inlet of the dispensing body for receiving diluent from the at least one diluent inlet. The diluent distribution ring includes a fluted lower end defining with the nozzle an array of passages in communication with the annular chamber for flow of diluent from the chamber and through the passages onto the nozzle diluent receiving surface. The nozzle diluent receiving surface may be a frusto-conical surface and the nozzle outlet a cylindrical outlet passage, and the juncture lies on a circle.

The invention also contemplates a beverage dispenser for dispensing a beverage into a cup. The beverage dispenser includes a beverage dispensing head comprising a nozzle having a diluent receiving surface leading to a juncture of the surface with an outlet from the nozzle, means for receiving liquid diluent, means for introducing received diluent onto the diluent receiving surface for flow along the surface to and past the juncture and through the nozzle outlet, means for receiving a plurality of liquid beverage syrups, and means for directing a plurality of discrete streams of a selected one of the syrups toward the juncture for impact against and admixture with diluent substantially at the juncture, so that admixed diluent and syrup exit the dispensing head through the nozzle outlet. The beverage dispenser advantageously further includes a flavor additive dispensing head comprising a nozzle having an outlet, means for receiving a plurality of liquid flavor additives, and means for directing a selected one of the flavor additives through the flavor additive dispensing head nozzle outlet.

The invention also contemplates a method of dispensing a beverage, comprising the steps of delivering liquid diluent onto a diluent receiving surface of a nozzle; flowing the diluent along the diluent receiving surface to and across a juncture between the diluent receiving surface and an outlet from the nozzle; directing a plurality of discrete streams of beverage syrup toward and against the diluent flow at the juncture between the diluent receiving surface and outlet for admixture of the diluent and beverage syrup; and flowing the admixture of diluent and beverage syrup out of the nozzle through the outlet.

In a preferred practice of the method, the diluent receiving surface is frusto-conical shaped, the nozzle outlet is a cylindrical passage and the juncture between the surface and outlet lies on a circle. The delivering step comprises coupling at least one diluent inlet to the beverage dispensing head to a source of diluent, and the directing step comprises coupling a plurality of syrup inlets to the beverage dispensing head to associated sources of beverage syrup, flowing syrup from the syrup inlets through selected ones of a plurality of associated passages that terminate in passage ends configured to emit discrete streams of syrup, and directing the streams of syrup emitted from the passage ends toward and against the diluent flow at the juncture between the diluent receiving surface and outlet passage. The passage ends are advantageously configured to emit a plurality of radially outward extending and arcuately spaced discrete streams of syrup, and the delivering step further comprises flowing diluent from the at least one diluent inlet into a chamber, and then flowing the diluent from the chamber through an array of passages arranged to deliver the diluent onto the diluent receiving surface of the nozzle.

OBJECT OF THE INVENTION

An object of the present invention is to provide a post-mix beverage dispensing head for use with a beverage dispenser, which provides improvements in the mixing of carbonated beverages.

Another object is to provide such a post-mix beverage dispensing head that yields improvements in maintenance of desired carbonation levels in dispensed carbonated beverages.

A further object is to provide such a post-mix beverage dispensing head that accommodates dispensing a plurality of different beverages from the same dispensing head while minimizing cross-contamination between different beverages dispensed.

DETAILED DESCRIPTION

Figure 1:
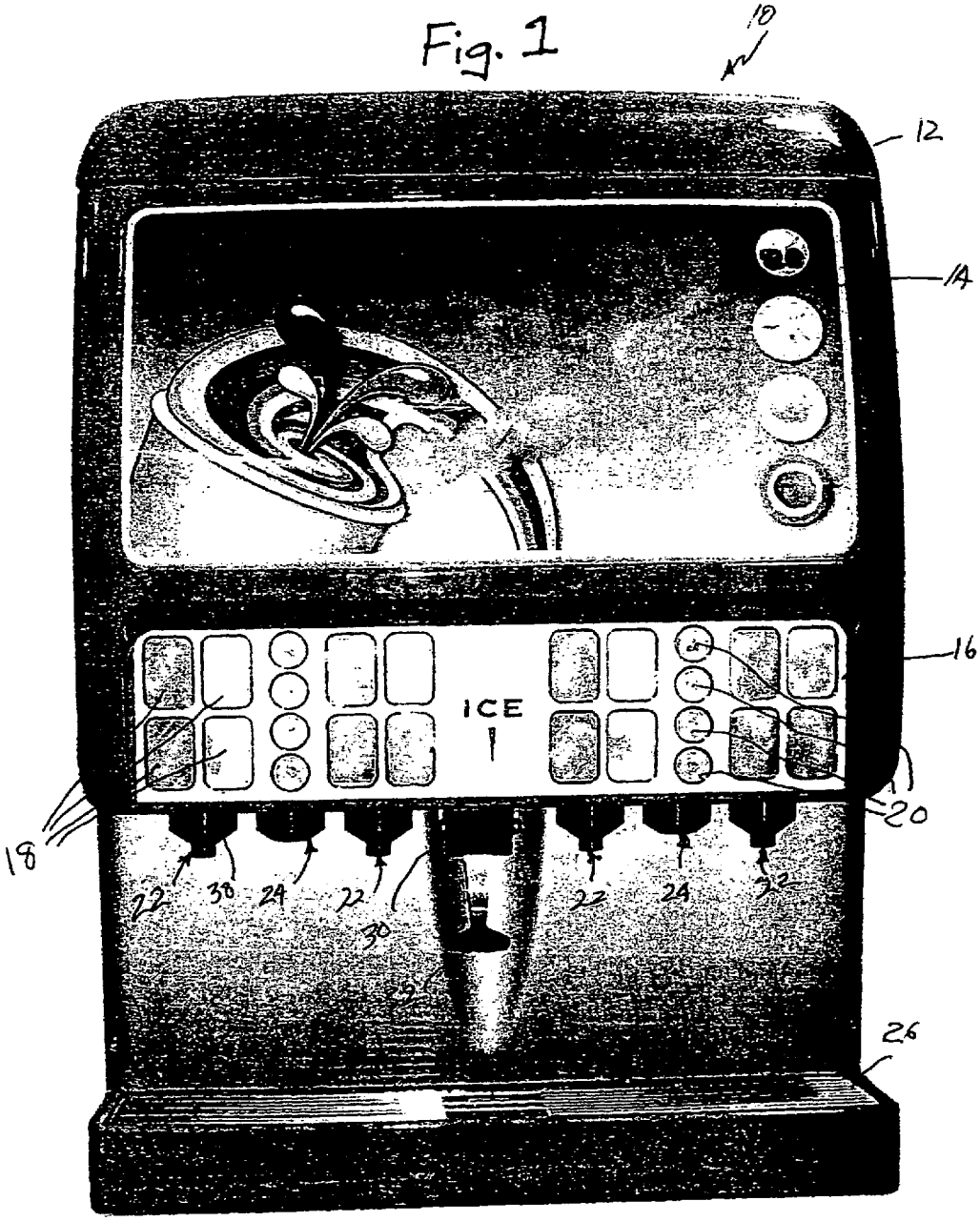
FIG. 1 shows a front elevation view of a flavor additive post-mix beverage dispenser embodying the teachings of the present invention.
Figure 2:
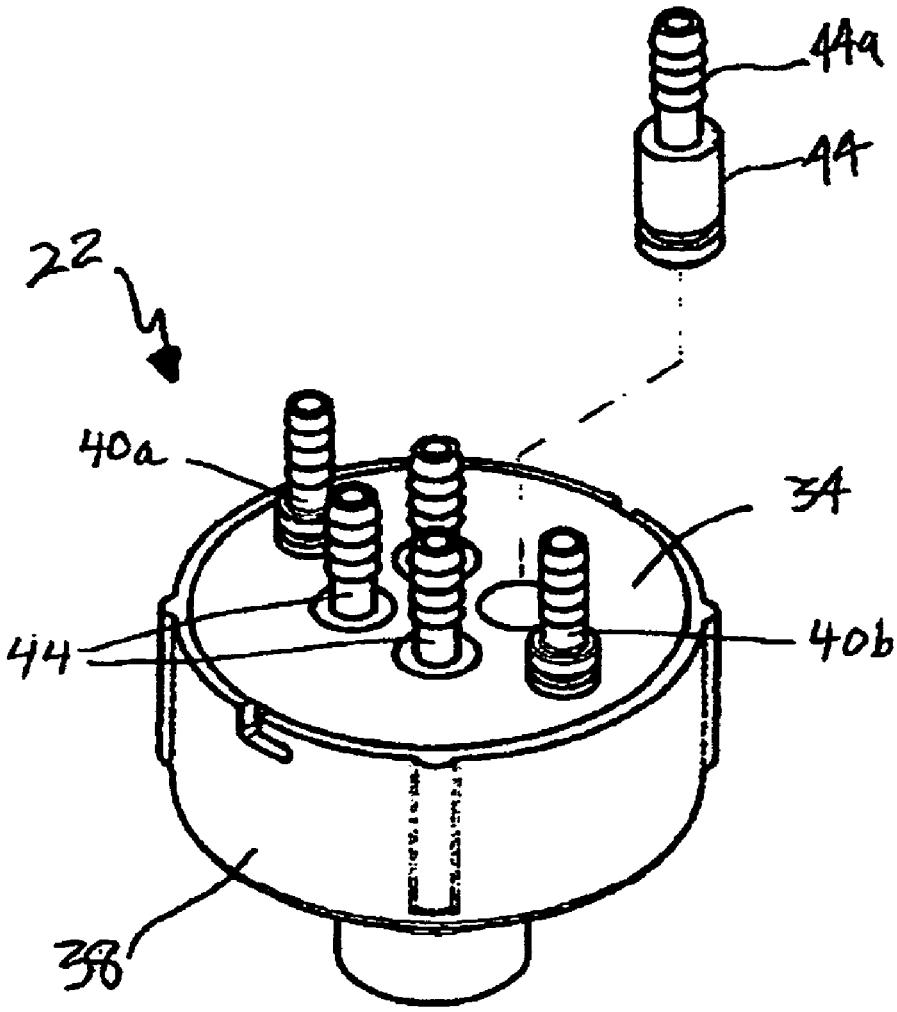
FIG. 2 shows a perspective and partially exploded view of one embodiment of a multiple flavor beverage dispensing head of the present invention.
Figure 3:
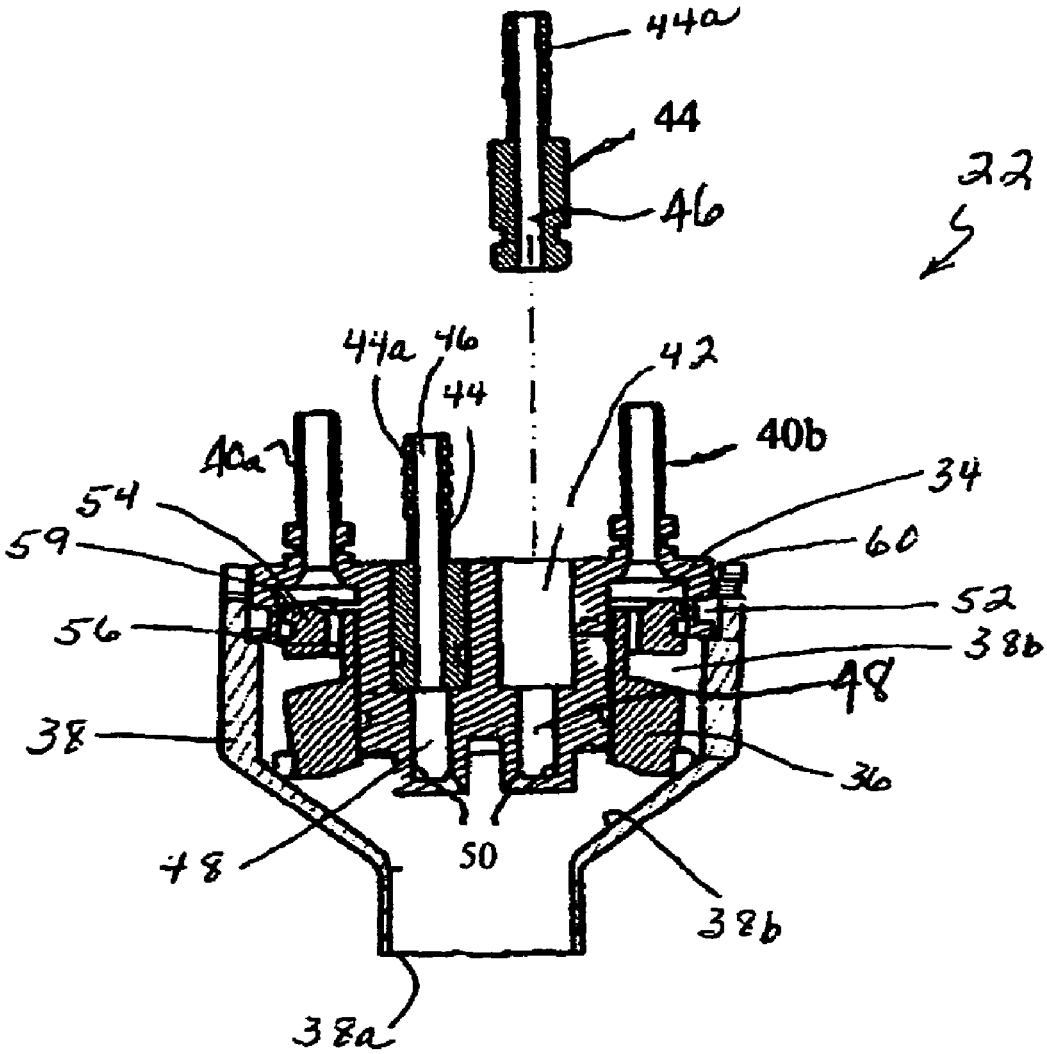
FIG. 3 is a cross-sectional view of the dispensing head of FIG. 2.
Figure 4A:
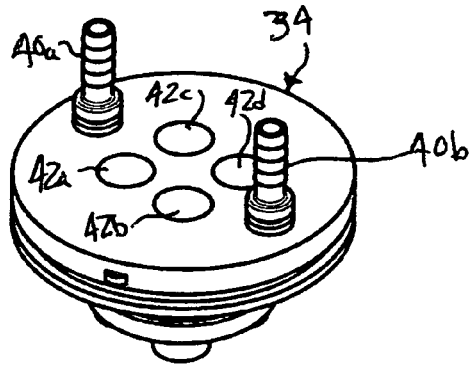
FIG. 4A shows a top perspective view of a main dispensing body of the multiple flavor dispensing head of FIG. 2.
Figure 4B:
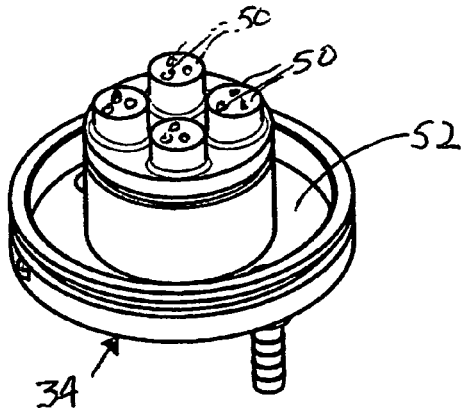
FIG. 4B is a bottom perspective view of the main dispensing body.
Figure 5A:
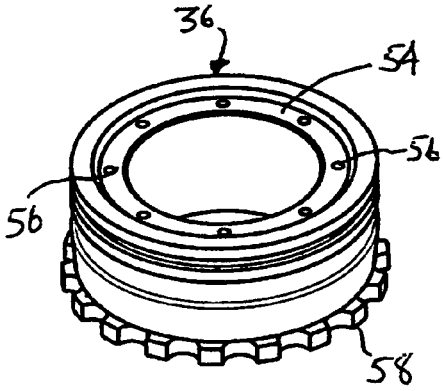
FIG. 5A shows a top perspective of a diluent flow distributing ring of the multiple flavor dispensing head of FIG. 2.
Figure 5B:
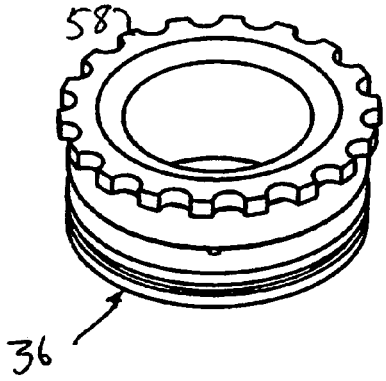
FIG. 5B is a bottom perspective of the diluent flow distributing ring.

As seen in FIG. 1, a flavor additive post-mix multiple flavor beverage dispenser embodying the teachings of the present invention is indicated generally at 10 and includes an outer housing 12 having a front advertising indicia panel 14 and a user interface comprising a drink and flavor selection panel 16. Panel 16 includes drink selection switches 18 and flavor additive selection switches 20. Below each group of four drink selection switches 18 is a multiple flavor post-mix beverage dispensing head 22, as seen more completely in FIG. 2. Below each group of four flavor additive selection switches 20 is a flavor additive dispensing head 24. Dispensing heads 22 and 24 are secured to dispenser 10 above a cup rest/drip tray 26 and on either side of an ice dispensing chute 30. As is conventional, ice is dispensed into a cup by operation of a lever arm 32 to cause an ice dispensing mechanism (not shown) within dispenser 10 to dispense ice retained in an ice storage bin (not shown) within the dispenser.

As best seen from FIGS. 2, 3, 4A, 4B, 5A and 5B, dispensing head 22 includes a main dispensing body 34, a diluent distribution ring 36 and a nozzle housing 38. Main dispensing body 34 includes two liquid diluent receiving inlet fittings 40*a* and 40*b* as well as four liquid syrup receiving inlets 42*a-d*. Inlets 42*a-d* fluid tightly receive four syrup inlet fittings 44 that include barbed ends 44*a* for securing to individual syrup supply lines (not shown) for connection to regulated and pressurized sources of individual syrups. Plugs 44 include central syrup flow channels 46 for fluidly communicating with respective ones of four syrup flow channels 48 in dispensing body 34. Channels 48, in turn, end in four angled outlet orifices 50. Dispensing body 34 also includes an O-ring receiving annular groove 52 for receiving an O-ring (not shown) to seal between the dispensing body and nozzle housing 38.

Diluent distribution ring 36 includes a top lip 54 having a plurality of diluent distribution passages 56. The bottom end of ring 36 includes a circular fluted diluent dispersing perimeter edge 58. Lip 54 of distribution ring 36 is fluid tightly received within an annular recess 59 of main dispensing body 34 to define between the diluent distribution ring and main dispensing body an annular diluent distribution channel 60 that communicates with the diluent distribution passages 56. Nozzle housing 38, in turn, is fluid tightly secured to main dispensing body 34.

Figure 6A:
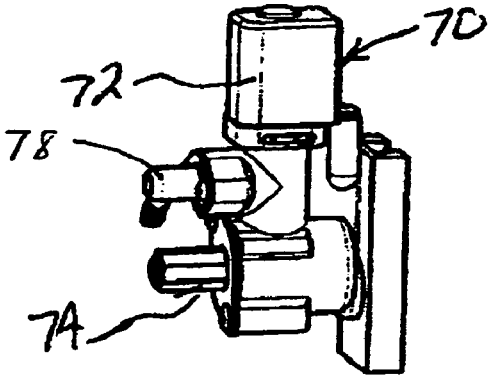
FIG. 6A shows a perspective view of a solenoid flow control valve for use with the multiple flavor dispensing head of FIG. 2.
Figure 6B:
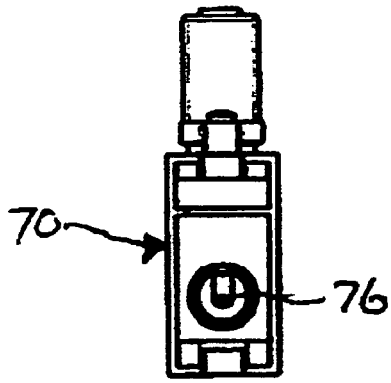
FIG. 6B is a rear elevation view of the control valve.

As seen in FIGS. 6A and 6B a solenoid operated flow control valve 70 includes a solenoid 72, a conventional piston type flow control mechanism 74 and, on the back side thereof, a Dole fitting 76 for providing releasable securing to a pressurized source of a beverage constituent. Those of skill will understand that such valves 70 are used to regulate the flow of liquid beverage constituents consisting, such as diluent, drink syrup or flavor additive, wherein each such valve is sized and adjusted to provide a desired flow of one such particular liquid. Valve 70 also includes an outlet 78 for connection to a plurality of tubes providing fluid connection to an associated one of the inlets 40*a*, 40*b* and 44 of the main dispensing body 34.

Figure 7:
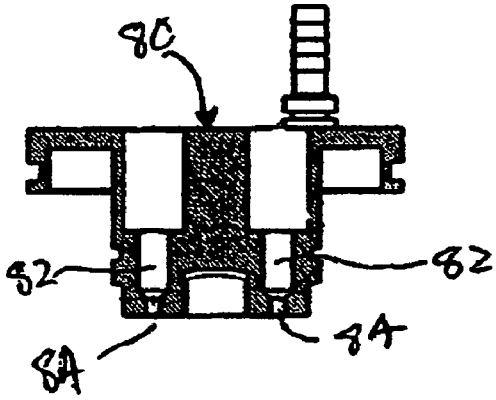
FIG. 7 shows a cross-sectional view of the main dispensing body of FIG. 4A.
Figure 8:
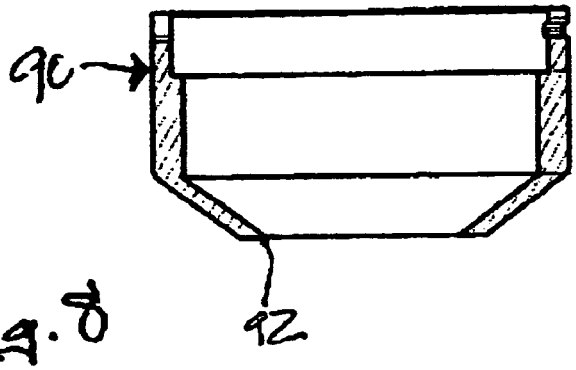
FIG. 8 shows a nozzle housing of the multiple flavor dispensing head of FIG. 2.
Figure 9:
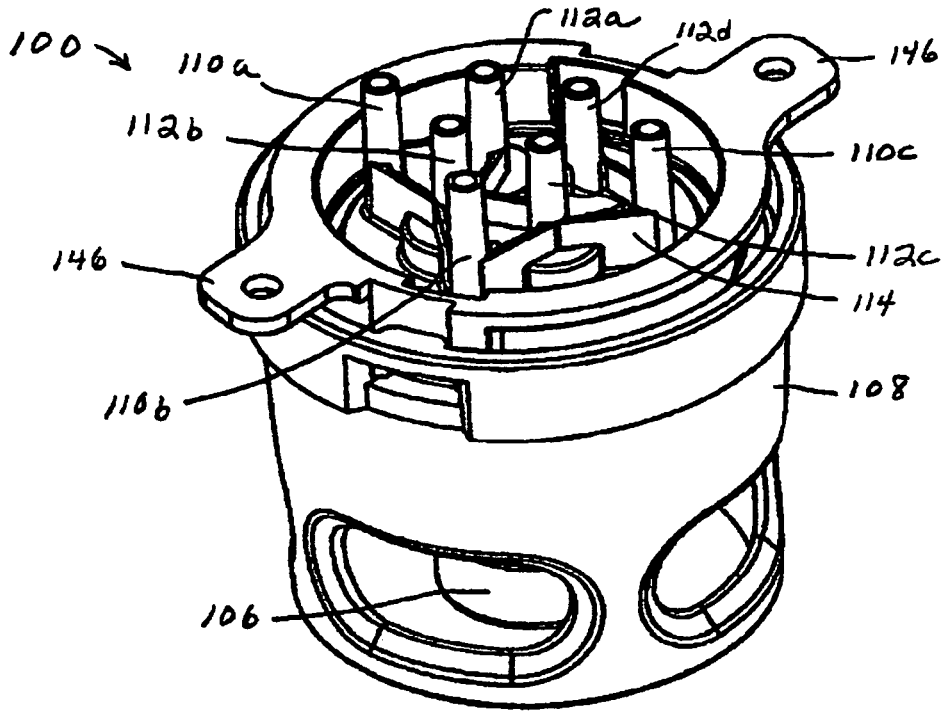
FIG. 9 is a perspective view of another embodiment of a multiple flavor beverage dispensing head embodying the teachings of the present invention.
Figure 10:
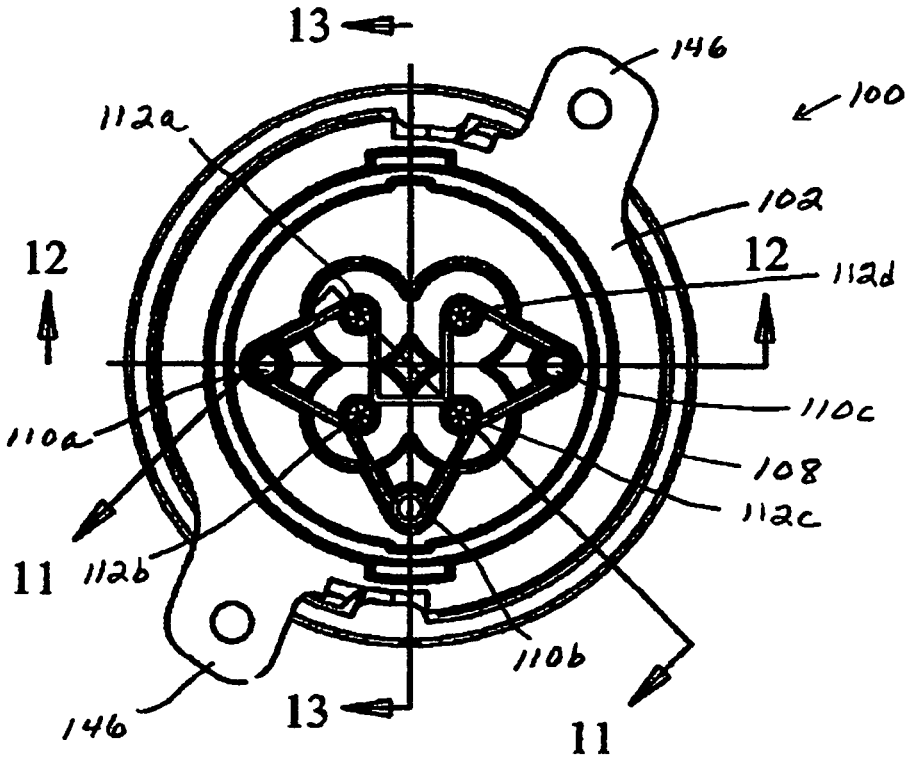
FIG. 10 is a top plan view of the multiple flavor dispensing head of FIG. 9.
Figure 11:
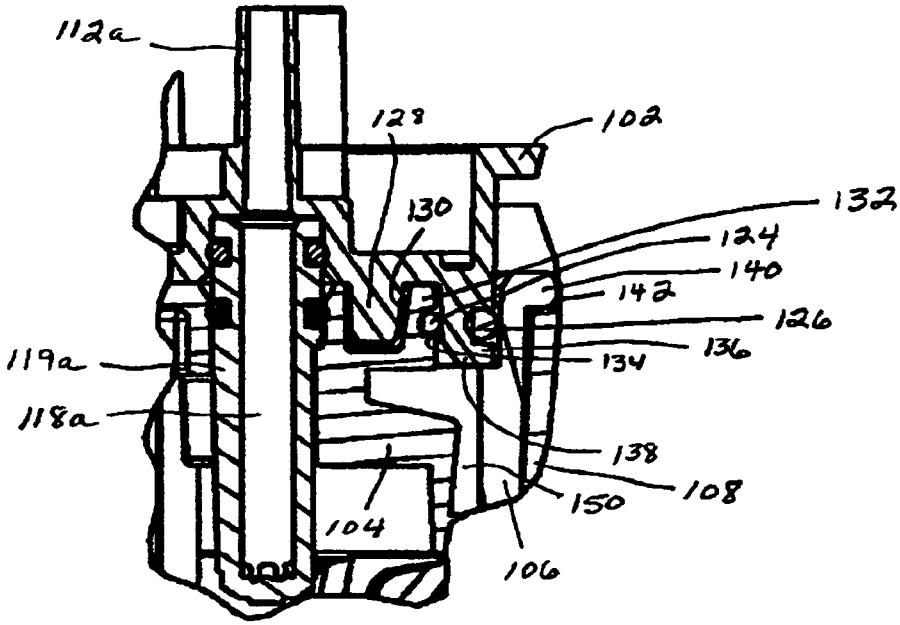
FIG. 11 shows a cross-sectional view taken substantially along the lines 11-11 of FIG. 10.
Figure 12:
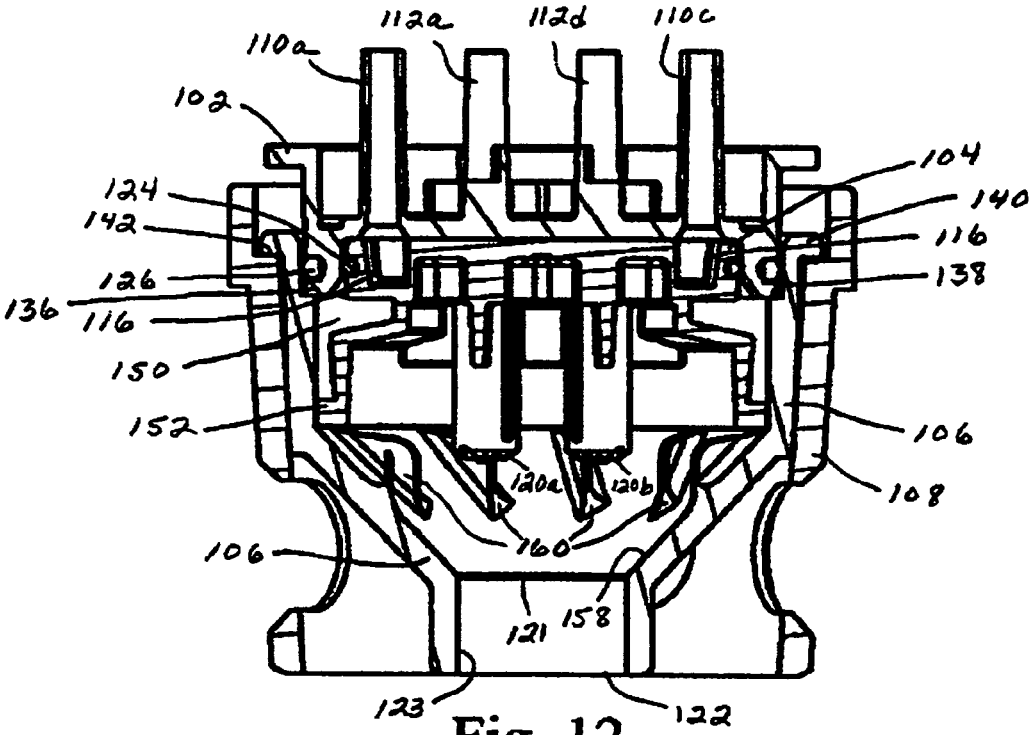
FIG. 12 shows a cross-sectional view taken substantially along the lines 12-12 of FIG. 10.
Figure 13:
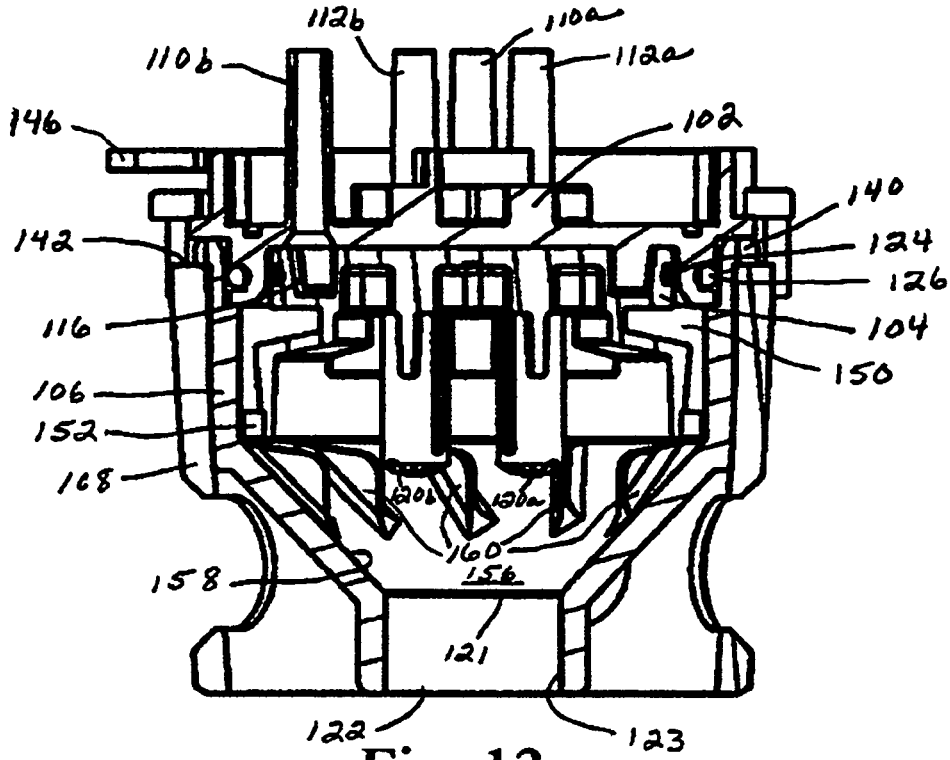
FIG. 13 shows a cross-sectional view taken substantially along the lines 13-13 of FIG. 10.
Figure 15:
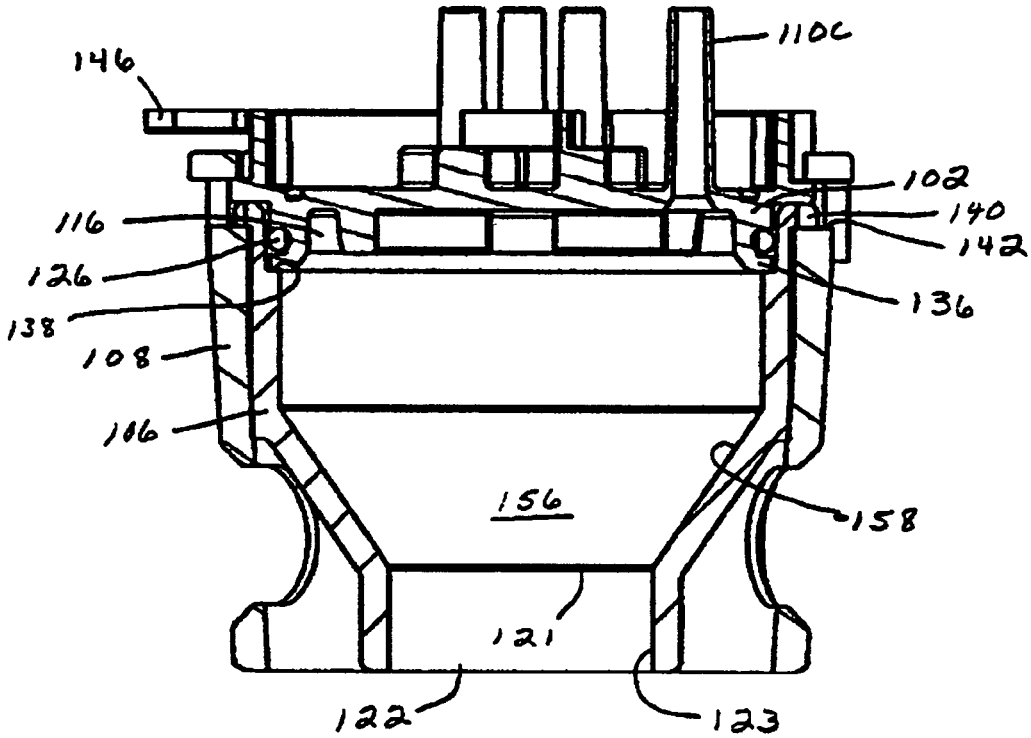
FIG. 15 shows a cross-sectional side elevation view of the portion of the multiple flavor dispensing valve as assembled.
Figure 14:
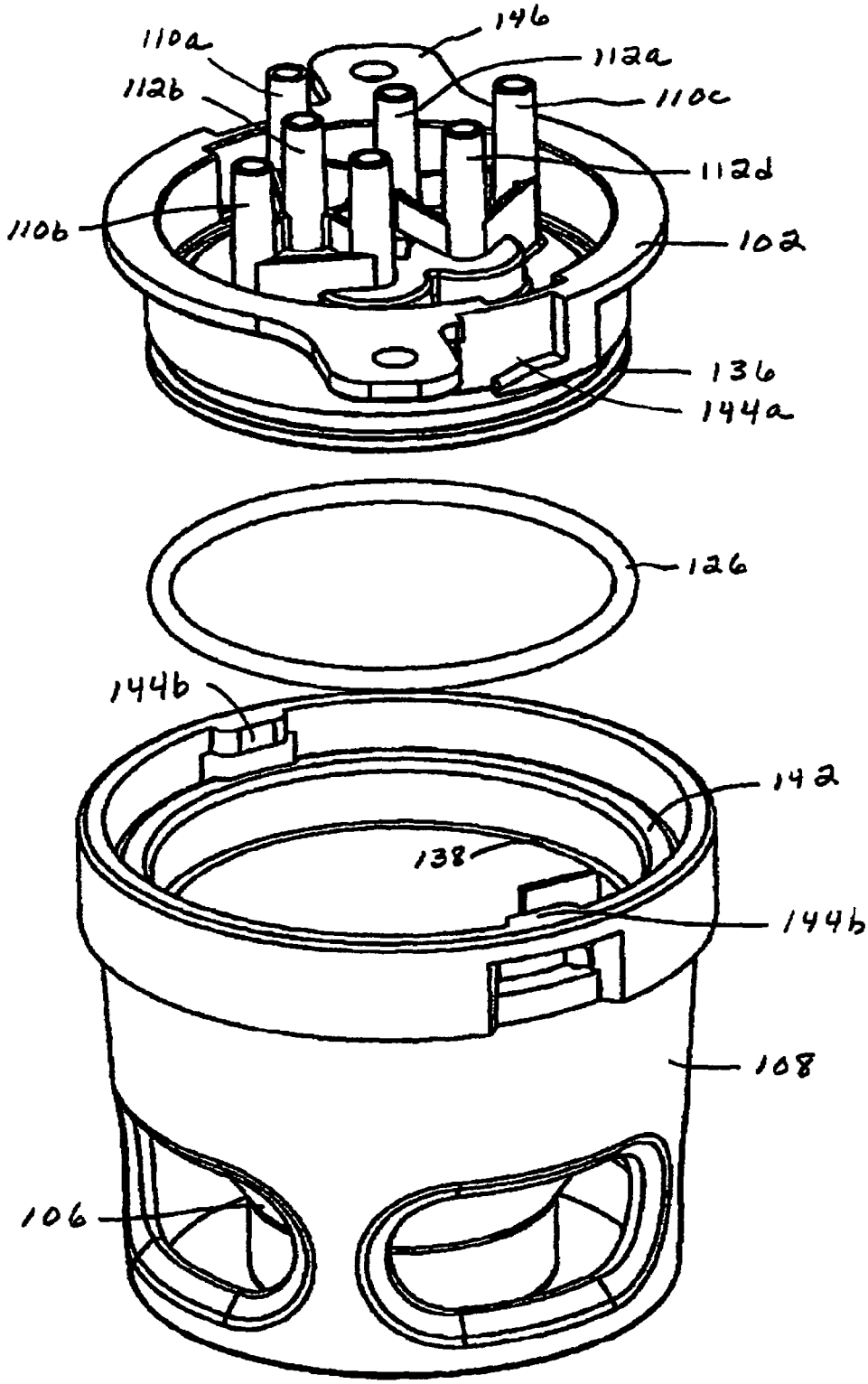
FIG. 14 is an exploded assembly view of a portion of the multiple flavor dispensing head of FIG. 9.
Figure 16:
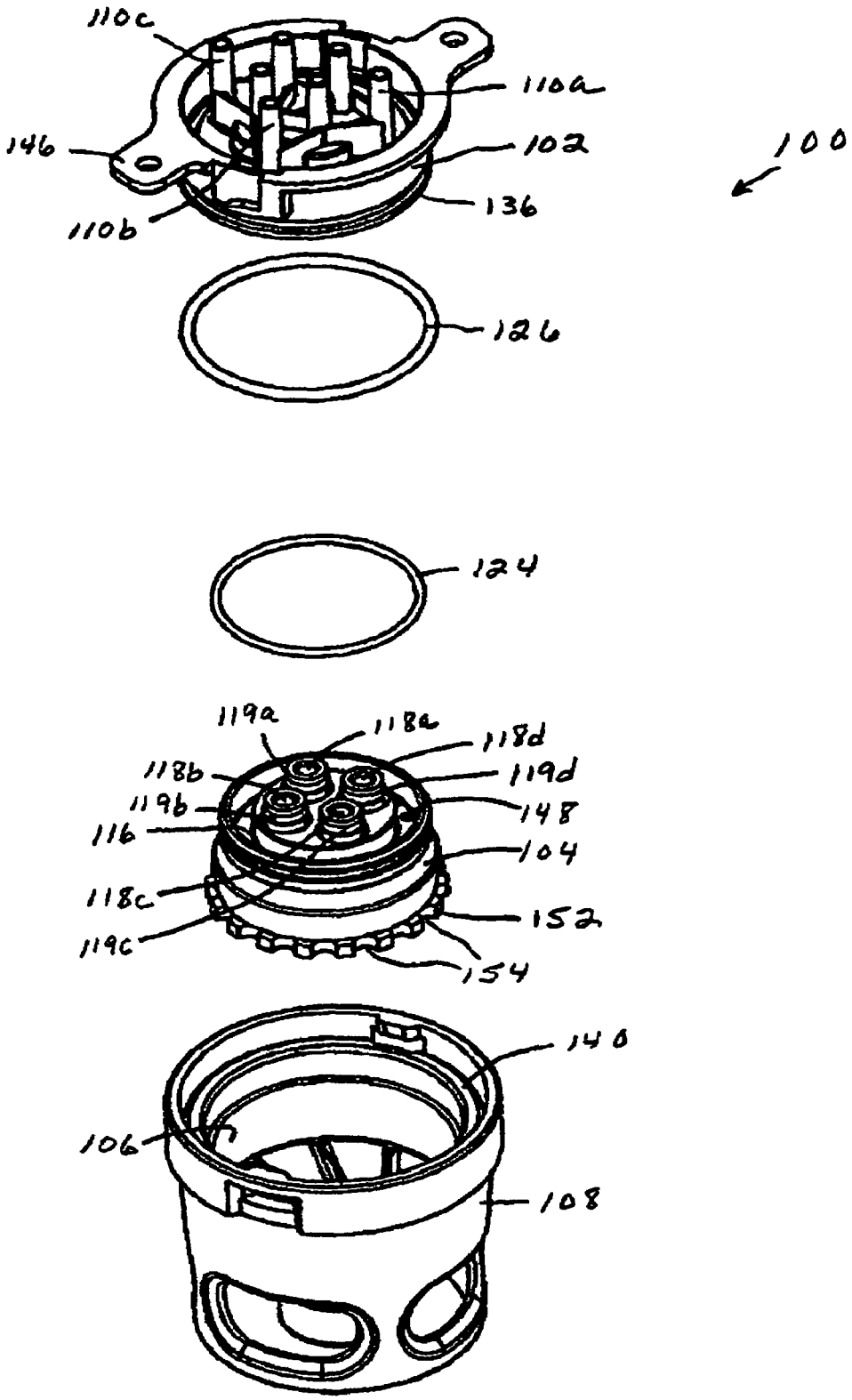
FIG. 16 is an exploded assembly view of the multiple flavor beverage dispensing head of FIG. 9.

The flavor additive dispensing heads 24 have a structure generally similar to that of the post-mix beverage dispensing heads 22, except that they do not have a diluent distribution ring and there are minor changes to their dispensing body and nozzle housing. Such differences are seen in FIGS. 7 and 8, where a main dispensing body 80 of flavor additive dispensing head 24 includes vertically extending syrup channels 82, each having a lower vertically extending dispensing orifice 84. A nozzle housing 90 of flavor additive dispensing head 24 includes a larger bottom perimeter opening 92, so that liquid flavor additives flowing from one or more of dispensing orifices 84 drop unimpeded directly downward into a cup in which they are to be dispensed. It is understood that diluent inlets are not used in flavor additive head 24.

In operation, ice may first be dispensed into a cup by movement of the cup against ice dispense lever arm 32. A beverage is then dispensed by placing a cup under a particular post-mix beverage dispensing head 22 and operating one of the drink selection dispense switches 18 associated with the dispensing head to open an associated solenoid operated flow control valves 70 for flow of liquid diluent and beverage syrup from dispensing head 22 into the cup. The beverage syrup flows through central channel 46 in one of the beverage syrup inlet fittings 44 and then into and through an associated channel 48 in main dispensing body 34 to and out of angled orifice 50 at the lower end of the channel into nozzle housing 38 for exit from a lower outlet opening 38*a* from the nozzle housing. The liquid diluent, in turn, flows through one of diluent inlet fittings 40*a* and 40*b* into annular diluent distribution channel 60 and from the channel into and through diluent distribution passages 56 into an annular chamber 38*b* defined between diluent distribution ring 36 and nozzle housing 38. The liquid diluent distributes throughout annular chamber 38*b* and from the annular chamber flows downward through arcuately spaced openings defined circumferentially around and between circular fluted peripheral edge 58 of diluent distribution ring 36 and an inner surface of nozzle housing 38. Liquid diluent flowing past fluted peripheral edge 58 flows across a frusto-conical shaped inward sloping interior surface 38*b* of nozzle housing 38 and is directed against and into admixture with beverage syrup exiting radially inwardly extending main dispensing body orifices 50 for exit with the beverage syrup from nozzle housing outlet 38*a* for flow into a cup positioned beneath beverage dispensing head 22.

A liquid flavor additive can be dispensed into the cup either before or after operating a dispense switch 18, by placing the cup below one of the flavor dispensing heads 24 and operating a selected one of the switches 20 associated with the flavor dispensing head. While it is known that a drink can be dispensed for as long as a switch 18 is depressed, in the case of a flavor additive, it is desirable to have the dispense timed, so that a known volume of flavor additive is dispensed with each activation of its corresponding switch. Such a set-up is desirable to dispense a correct volume of flavor additive and to guard against overuse of the additive.

The present invention can provide for a further variety of dispensed drinks due to the use of two diluent inlets 40*a* and 40*b* for each beverage dispensing head 22. For example, two different diluents can be used, wherein diluent inlet 40*a* is connected with a regulated source of carbonated water and diluent inlet 40*b* is connected with a regulated source of non-carbonated or flat water. Thus, any of the main drinks can be carbonated or non-carbonated.

A preferred embodiment of multiple flavor post-mix beverage dispensing head adapted for use with beverage dispenser 10 is shown in FIGS. 9-16 and indicated generally at 100. Dispensing head 100 includes a main dispensing body 102, a diluent distribution ring 104, a nozzle housing 106 and a dispensing head housing 108. Main dispensing body 102 includes three liquid diluent receiving inlets 110*a-c* and four liquid syrup receiving inlets 112*a-d*, all of which inlets are strengthened by ribs 114. Diluent receiving inlets 110*a-c* connect through associated diluent supply lines (not shown) to regulated and pressurized sources of liquid diluent and syrup receiving inlets 112*a-d* connect through associated syrup supply lines to regulated and pressurized sources of individual syrups. Diluent inlets 110*a-c* communicate with an annular channel 116 formed in an upper end of diluent distribution ring 104 and closed by main dispensing body 102 when the main dispensing body and diluent distribution ring are assembled. Syrup inlets 112*a-d*, in turn, communicate with inlets to associated passages 118*a-d* of fittings 119*a-c*, which fittings extend through openings in and are sealed by O-rings to distribution ring 104. Lower liquid syrup outlet ends 120*a-d* of fitting passages 118*a-d* are each configured to emit a plurality of streams of syrup, such as six streams, outward and downward therefrom, such that the syrup streams are directed toward an interior surface of nozzle housing 106 at a circular juncture 121 between an upper frusto-conical shaped surface 158 and a lower cylindrical outlet surface 123 of the nozzle housing, for exit through a lower outlet opening 122 from the nozzle housing.

An O-ring 122 in an annular groove in diluent distribution ring 104 seals the diluent distribution ring to main dispensing body 102, while an O-ring 126 in an annular groove in the main dispensing body seals the main dispensing body to the nozzle housing 106. Assembly of dispensing head 100 is accomplished, in part, by bringing main dispensing body 102 and diluent distribution ring 104 together to extend an annular ridge 128 on a lower end of the main dispensing body into an annular recess 130 in an upper surface of the diluent distribution ring and to extend an annular ridge 132 on an upper end of the diluent distribution ring into an annular recess 134 in a lower end of the main dispensing body, with O-ring 124 then sealing between the main dispensing body and diluent distribution ring. Further assembly of dispensing head 100 is accomplished by extending main dispensing body 102 and diluent distribution ring 104 into an upper end of nozzle housing 106 until a lower surface of a downward extending circumferential ridge 136 on a lower end of the main dispensing body sits on a radially inward extending circular shoulder 138 of the nozzle housing, with O-ring 126 then sealing between the main dispensing body and the nozzle housing. Main dispensing body 102, diluent distribution ring 104 and nozzle housing 106 are then assembled to dispensing head housing 108 by extending the same into an open upper end of dispensing head housing 108 until a radially outward extending annular lip 140 at an upper end of nozzle housing 106 rests on a radially inward extending annular shoulder 142 of dispensing head housing 108. During assembly of main dispensing body 102, diluent distribution ring 104 and nozzle housing 106 to dispensing housing 108, a bayonet locking structure 144*a-b* carried by the main dispensing body and dispensing head housing 108 is engaged to releasably lock the assembly together, with radially outward extending handles 146 at an upper end of the main dispensing body facilitating the assembly and releasable locking operation.

Diluent distribution ring 104 has a plurality of diluent distribution passages 148 extending downward from inlets to the passages at diluent distribution ring annular channel 116 to outlets from the passages at an annular chamber 150 defined between circumferential ridge 136 of main dispenser body 102, nozzle housing 106 and the diluent distribution ring. Diluent distribution ring 104 includes a circular fluted diluent dispersing perimeter edge 152 defining a lower end of annular chamber 150, such that a plurality of circumferentially spaced recesses 154 in perimeter edge 152 define a circular array of arcuately spaced outlet openings from the annular chamber. The arrangement is such that liquid diluent introduced at diluent inlets 110*a-c* enters and is dispersed around annular channel 116, from which annular channel the diluent flows through passages 148 into annular chamber 150. The diluent exits chamber 150 through the circular array of outlet openings defined by perimeter edge recesses 154 and flows into nozzle housing frusto-conical surface 158 within a lower diluent/syrup mixing area 156 of nozzle housing 106. A plurality of arcuately spaced water control directional ribs 160 on frusto-conical surface 158 prevent swirling of liquid diluent flowing downward along the surface to provide a generally laminar flow of diluent for mixing with syrup at nozzle junction 121. The diluents, as is customary, are carbonated and plain or flat water and three diluent inlets 110*a-c* advantageously are provided to ensure uniform distribution of diluent around and within annular chamber 116 when the diluent is carbonated water, and thereby uniform distribution of carbonated water around and within diluent/syrup mixing area 156 of nozzle 106. This is accomplished by delivering carbonated water diluent to each of diluent inlets 110*a* and 110*c*, which are located on opposite sides of the annular channel 116 and thereby provide for uniform distribution of carbonated water diluent throughout the chamber, while plain water diluent is delivered only to diluent inlet 110*b*.

To mix beverage syrup with diluent within diluent/syrup mixing area 156 of nozzle housing 106, beverage syrup delivered to one of the syrup inlets 112*a-d* flows through passage 118*a-d* of associated fitting 119*a-d* for exit from associated passage outlet 120*a-d* as a plurality of streams of syrup that are directed toward juncture 121 within the diluent/syrup mixing area. The streams of syrup join at juncture 121 with diluent flowing down frustoconical surface 158 of nozzle housing 106 for mixing with the diluent and exiting through the nozzle outlet 122 as a beverage that is dispensed into a cup below the nozzle outlet.

While not specifically shown for use in connection with dispensing head 100, it is understood that the FIGS. 9-16 embodiment of dispensing head would be fluid coupled with a plurality of solenoid control valves, such as valves 70, for controlled delivery of diluent and syrup to the dispensing head. It also is understood that a dispenser 10 embodying one or more dispensing heads 100 could also be provided with flavor additive dispensing heads 24 of a type as shown and described in connection with FIGS. 7 and 8.

In operation, ice may first be dispensed into a cup by movement of the cup against ice dispense lever arm 32. A beverage is then dispensed by placing the cup under a particular post-mix beverage dispensing head 100 and operating one of the drink selection dispense switches 18 associated with the dispensing head to open associated flow control valves 70 for flow of liquid diluent and beverage syrup from dispensing head 22 into the cup. In this connection, the diluent flow control valve 70 opens before and closes after the beverage syrup control valve, so that diluent is delivered to dispensing head 100 before, during and after the delivery of syrup. The beverage syrup delivered to one of the syrup inlets 112*a-d* of beverage dispensing head 100 flows through passage 118*a-d* of associated fitting 119*a-d* and exits from associated passage outlet 120*a-d* as a plurality of discrete streams of syrup that are directed toward juncture 121 within mixing area 156 of nozzle housing 106. The liquid diluent introduced at diluent inlets 110*a* and 110*c* or at diluent inlet 110*b* enters annular channel 116, from which it flows through diluent distribution ring passages 148 into annular chamber 150 for exit from the chamber through the circular array of outlet openings defined by perimeter edge recesses 154 of diluent distribution ring 106. Upon exiting the circular array of passages the diluent flows onto frusto-conical surface 158 of diluent/syrup mixing area 156, with the plurality of arcuately spaced water control directional ribs 160 then preventing swirling of liquid diluent on the frusto-conical surface, so that there is a generally laminar flow of diluent into which syrup is directed and admixed at the nozzle housing juncture 121. The admixture of diluent and syrup is then dispensed through nozzle housing outlet 122 as a beverage into the cup positioned below dispensing head 100. It is appreciated that because introduction of diluent into dispensing head 100 begins before and ends after the introduction of syrup into the dispensing head, diluent always coats the interior surfaces of nozzle mixing area 156 during introduction of syrup and washes the interior surfaces dean after the flow of syrup is ended, so that the interior surfaces remain clean and cross-contamination of beverages is avoided.

Those of skill will appreciate that the present invention uses separate dispensing heads for each of the main drinks and flavor additives. Thus, all three functions of dispensing ice, main drink and flavor additive are physically and spatially separated. This approach provides for a very intuitive and natural use of the beverage dispenser by the public. It is understood that dispensing of the three components, ice, beverage and additive, can be done in any order, which further enhances user friendliness. The layout of the various drink dispense and flavor additive switches 18 and 20 above the particular main beverage dispensing heads 22 and 100 and above the flavor additive dispensing head 24 further adds to user friendliness of the dispenser.

While embodiments of the invention have been described in detail, various modifications and other embodiments thereof may be devised by one skilled in the art without departing from the spirit and scope of the invention, as defined in the appended claims.

What is claimed is:

1. A beverage dispensing head for a beverage dispenser, comprising a main dispensing body having a plurality of liquid syrup introduction passages and at least one liquid diluent introduction passage for connection at inlets thereto to respective supplies of syrups and diluent; a nozzle having a diluent receiving surface that leads to a line juncture of said diluent receiving surface with an outlet from said nozzle; and a diluent distribution ring intermediate said main dispensing body and said nozzle for receiving diluent from said main dispensing body and for directing the diluent onto said nozzle diluent receiving surface for flow along said surface to and past said juncture and through said nozzle outlet, said diluent distribution ring including a plurality of syrup flow passages each for flow of syrup from an associated one of said main dispensing body syrup introduction passages to said nozzle, each said syrup flow passage having an outlet at said nozzle for emitting a plurality of discrete streams of liquid beverage syrup that are directed toward said line juncture for impact against and admixture with diluent substantially at said juncture, so that admixed diluent and syrup exit said nozzle through said nozzle outlet, wherein said diluent distribution ring has a chamber in communication with said at least one diluent introduction passage of said main dispensing body for receiving diluent from said at least one diluent introduction passage before the diluent is directed onto said nozzle diluent receiving surface, and wherein said diluent distribution ring chamber is an annular chamber and said diluent distribution ring includes a fluted lower end defining with said nozzle an array of passages in communication with said annular chamber for flow of diluent from said chamber and through said passages onto said nozzle diluent receiving surface.

2. A beverage dispensing head as in claim 1, said nozzle including a plurality of ribs extending along said nozzle diluent receiving surface for guiding a flow of diluent along said diluent receiving surface.

3. A beverage dispensing head as in claim 1, wherein said nozzle diluent receiving surface is a frusto-conical surface, said nozzle outlet is a cylindrical outlet passage, and said juncture lies on a circle.

4. A beverage dispensing head as in claim 1, wherein said main dispensing body at least one diluent introduction passage comprises at least first and second diluent introduction passages in communication with said diluent distribution ring annular chamber for introducing diluent into said annular chamber at generally diametrically opposite locations to fill said chamber with diluent.

5. A beverage dispensing head as in claim 4, wherein said main dispensing body includes a third diluent introduction passage in communication with said annular chamber, said first and second diluent introduction passages being for connection with a source of carbonated water and said third diluent introduction passage being for connection with a source of plain water.

* * * * *